US010098443B2

(12) United States Patent
Butler

(10) Patent No.: US 10,098,443 B2
(45) Date of Patent: Oct. 16, 2018

(54) ARM WORN HYDRATION DEVICE

(71) Applicant: Robert Butler, Benson, VT (US)

(72) Inventor: Robert Butler, Benson, VT (US)

(73) Assignee: Sinergy, LLC, Benson, VT (US)

( * ) Notice: Subject to any disclaimer, the term of this patent is extended or adjusted under 35 U.S.C. 154(b) by 0 days.

(21) Appl. No.: 15/638,066

(22) Filed: Jun. 29, 2017

(65) Prior Publication Data

US 2017/0360184 A1 Dec. 21, 2017

Related U.S. Application Data

(63) Continuation-in-part of application No. 29/568,199, filed on Jun. 16, 2016.

(51) Int. Cl.

| | |
|---|---|
| ***A45F 5/00*** | (2006.01) |
| ***A45F 3/20*** | (2006.01) |
| ***A45C 13/30*** | (2006.01) |
| *A45F 3/16* | (2006.01) |

(52) U.S. Cl.

CPC ..... *A45F 3/20* (2013.01); *A45C 13/30* (2013.01); *A45F 3/16* (2013.01); *A45F 2003/166* (2013.01)

(58) Field of Classification Search

CPC ..... A45F 3/16; A45F 3/20; A45F 5/00; A45C 13/30

USPC ..... 224/148.2, 148.4, 218–222

See application file for complete search history.

(56) References Cited

U.S. PATENT DOCUMENTS

| | | | | |
|---|---|---|---|---|
| 2,881,441 | A * | 4/1959 | Bass | A41D 27/10 2/1 |
| 4,736,876 | A * | 4/1988 | Kriss | A45C 1/04 222/175 |
| 4,788,631 | A | 11/1988 | Fuller | |
| 4,988,097 | A | 1/1991 | Smith et al. | |
| D315,245 | S | 3/1991 | Envall | |
| D323,430 | S | 1/1992 | Niederkorn | |
| D373,240 | S | 9/1996 | Parnell | |
| 5,566,869 | A | 10/1996 | Katz | |
| D404,908 | S | 2/1999 | Lollis | |
| D408,988 | S | 5/1999 | Barber et al. | |
| 5,938,089 | A | 8/1999 | Abreu-Marston | |
| 6,173,866 | B1 | 1/2001 | Lucian | |
| 6,330,961 | B1 * | 12/2001 | Borja | A45C 1/04 224/221 |
| 6,409,048 | B1 * | 6/2002 | Belzeski | A45F 3/04 222/103 |
| D515,805 | S | 2/2006 | Jones | |
| D538,030 | S | 3/2007 | Karl et al. | |
| D539,028 | S | 3/2007 | Robins et al. | |
| D655,496 | S | 3/2012 | Lamey et al. | |
| 8,167,177 | B1 | 5/2012 | Galgano | |
| 8,387,831 | B2 | 3/2013 | McInerney | |
| D691,367 | S | 10/2013 | Chappel | |
| 8,602,073 | B2 * | 12/2013 | Swain | A45F 3/00 150/106 |

(Continued)

*Primary Examiner* — Brian D Nash

(74) *Attorney, Agent, or Firm* — Justin W. McCabe; Dunkiel Saunders Elliott Raubvogel & Hand, PLLC

(57) ABSTRACT

A hydration device is provided that includes a sleeve that is worn securely on a limb, such as a forearm, of a user and contains a bladder for holding liquid such as water, sports drinks, etc. The bladder is removable and includes a refill port and a drinking valve. The hydration device can be designed to absorb impacts while being worn, yet is light-weight and flexible enough to conform to the user's body.

18 Claims, 15 Drawing Sheets

(56) References Cited

U.S. PATENT DOCUMENTS

| | | | | |
|---|---|---|---|---|
| 8,622,262 | B2 * | 1/2014 | Van Art | A45F 3/20 224/148.2 |
| D708,846 | S | 7/2014 | Waldon | |
| 9,113,699 | B2 | 8/2015 | Radosta | |
| 9,144,168 | B2 * | 9/2015 | Sedillo | H05K 7/02 |
| D744,662 | S | 12/2015 | Stevens et al. | |
| D744,746 | S | 12/2015 | Ballestreros | |
| 9,238,539 | B2 | 1/2016 | Lynch | |
| D749,315 | S | 2/2016 | Ross | |
| D802,293 | S * | 11/2017 | Sola | D3/202 |
| D802,294 | S * | 11/2017 | Sola | D3/202 |
| 2001/0020628 | A1 * | 9/2001 | Campion | A45C 11/22 222/103 |
| 2006/0011679 | A1 * | 1/2006 | Santiago | B25H 3/00 224/222 |
| 2009/0272774 | A1 * | 11/2009 | Craig | A45F 5/00 224/222 |
| 2010/0001022 | A1 | 1/2010 | McInerney | |
| 2010/0019006 | A1 | 1/2010 | Van Art | |
| 2010/0059559 | A1 * | 3/2010 | Given | A45F 5/00 224/222 |
| 2012/0048898 | A1 | 3/2012 | Franklin et al. | |
| 2012/0152986 | A1 | 6/2012 | Van Art | |
| 2013/0026248 | A1 | 1/2013 | Paulsen et al. | |
| 2013/0098955 | A1 * | 4/2013 | Lamey | A45F 5/00 224/222 |
| 2014/0131402 | A1 * | 5/2014 | Holmes | A45F 5/00 224/222 |
| 2017/0202343 | A1 | 7/2017 | Sola et al. | |

* cited by examiner

ARM WORN HYDRATION DEVICE

RELATED APPLICATION DATA

This application is a continuation-in-part of U.S. Design patent application Ser. No. 29/568,199 titled "Fluid Container" and filed on Jun. 16, 2016, which is incorporated herein in its entirety.

FIELD OF THE INVENTION

The present invention generally relates to hydration devices. In particular, the present invention is directed to an arm worn device for carrying a refillable fluid container.

BACKGROUND

Medical research has demonstrated the importance of maintaining adequate hydration while engaging in strenuous physical activities, such as running, bicycling, hiking, or mountain climbing. In the not too distant past, participants in such activities carried their water in bottles or canteens from which they drank periodically. More recently, personal hydration systems have been developed that allow users to drink more or less continuously while engaged in sporting or recreational activities. These personal hydration systems typically have a bag-like fluid reservoir that is carried in a back- or waist-mounted pack. A long flexible tube is connected to the reservoir through an exit port at one end and terminates in a mouthpiece at the other end. The tube is long enough to allow the mouthpiece to be carried in the user's mouth to enable the user to draw water from the reservoir at will. Examples of hydration systems and mouthpieces therefore are disclosed in U.S. Pat. Nos. 5,727,714; 5,060,833; 5,085,349; and 6,070,767, the disclosures of which are hereby incorporated by reference.

Athletes have been continuously searching for an edge to compete longer, finish stronger, and remain healthy and competitive. Keeping hydrated has been routinely recognized by athletes as an important contributor to these goals. In fact, during races such as marathons, athletes will often carry liquids (typically water or a drink containing electrolytes, such as Gatorade®, produced by The Gatorade Company, a Delaware Corporation, and a division of PespiCo, Inc.) in addition to consuming liquids provided by the race coordinators. Carrying devices created for runners, however, have many deficiencies when used for other competitive sports where there is physical contact with other athletes or obstacles.

SUMMARY OF THE DISCLOSURE

An exemplary aspect of the present disclosure provides a body worn hydration device that has a sleeve with a dorsal side, the sleeve sized and configured to fit over a user's arm such that the sleeve has a generally tubular shape that tapers from a proximal end to a distal end, and the sleeve includes an aperture on the dorsal side and a sealable opening. The device also includes a bladder sized and configured to hold a liquid, to be removably contained within the sleeve on the dorsal side of the sleeve, and to be inserted into and removed from the sleeve through the sealable opening. The bladder further includes a valve port and a refill port, wherein the valve port is positioned such that when the bladder is contained within the sleeve the valve port protrudes through the aperture.

In another exemplary aspect of the present disclosure, a wearable device for containing a liquid to be drunk by the wearer is provided, the device consists essentially of a sleeve with an inside portion and an outside portion, the sleeve sized and configured such that the inside portion fits on a user's forearm and the sleeve has a generally tubular shape that tapers from a proximal end to a distal end, wherein the sleeve includes an aperture and a sealable opening, and a bladder sized and configured to be removably contained within the sleeve between the inside portion and the outside portion and to be inserted and removed through the sealable opening, the bladder including a valve port and a refill port, wherein the valve port is positioned such that when the bladder is contained within the sleeve the valve port protrudes through the aperture, wherein the device is sized and configured to not extend past a wrist toward a hand of a user when worn.

Yet another exemplary aspect of the present disclosure provides a body worn hydration device that includes a sleeve with a dorsal side, the sleeve sized and configured to fit over a user's arm such that the sleeve has a generally tubular shape that tapers from a proximal end to a distal end, wherein the sleeve has a first side running along a length of the sleeve and a second side running along the length of the sleeve on an opposite side. The device also includes a cover coupled to said sleeve, wherein the cover has a first edge that is attached to the first side substantially along the length of the sleeve, wherein the cover has a second edge that is attached to the second side substantially along the length of the sleeve, wherein the cover is positioned substantially on the dorsal side of the sleeve and forms a pocket on the dorsal side of the sleeve, and wherein the cover includes a first aperture. The device further includes a bladder sized and configured to hold liquid and to be removably contained within the pocket, wherein the bladder includes a refill port and a valve port, and wherein the valve port is positioned such that when the bladder is in the pocket the valve port can protrude from the first aperture.

BRIEF DESCRIPTION OF THE DRAWINGS for the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

A hydration device as disclosed herein provides a refillable liquid apparatus that can be worn by athletes, especially those engaged in competitive organized sports, e.g., marathons, soccer, obstacle course races, etc., or athletic events in which high levels of contact are to be expected. The hydration device allows for ready refilling without removal of the device from the user's body and in certain embodiments the proximity of the hydration device's bladder to the skin allows for cooling of the athlete. The hydration device can be designed and configured to absorb impacts while being worn, yet is light-weight and flexible enough to conform to the user's body. The hydration device also includes a valve mechanism that is accessible by the user during the event or competition, yet is resistant to infiltration by dirt or other contaminants. The hydration device can also provide for storage of items that the user may desire to carry during the competition and/or can be outfitted with identification information or GPS locators for tracking purposes.

Figure 1:
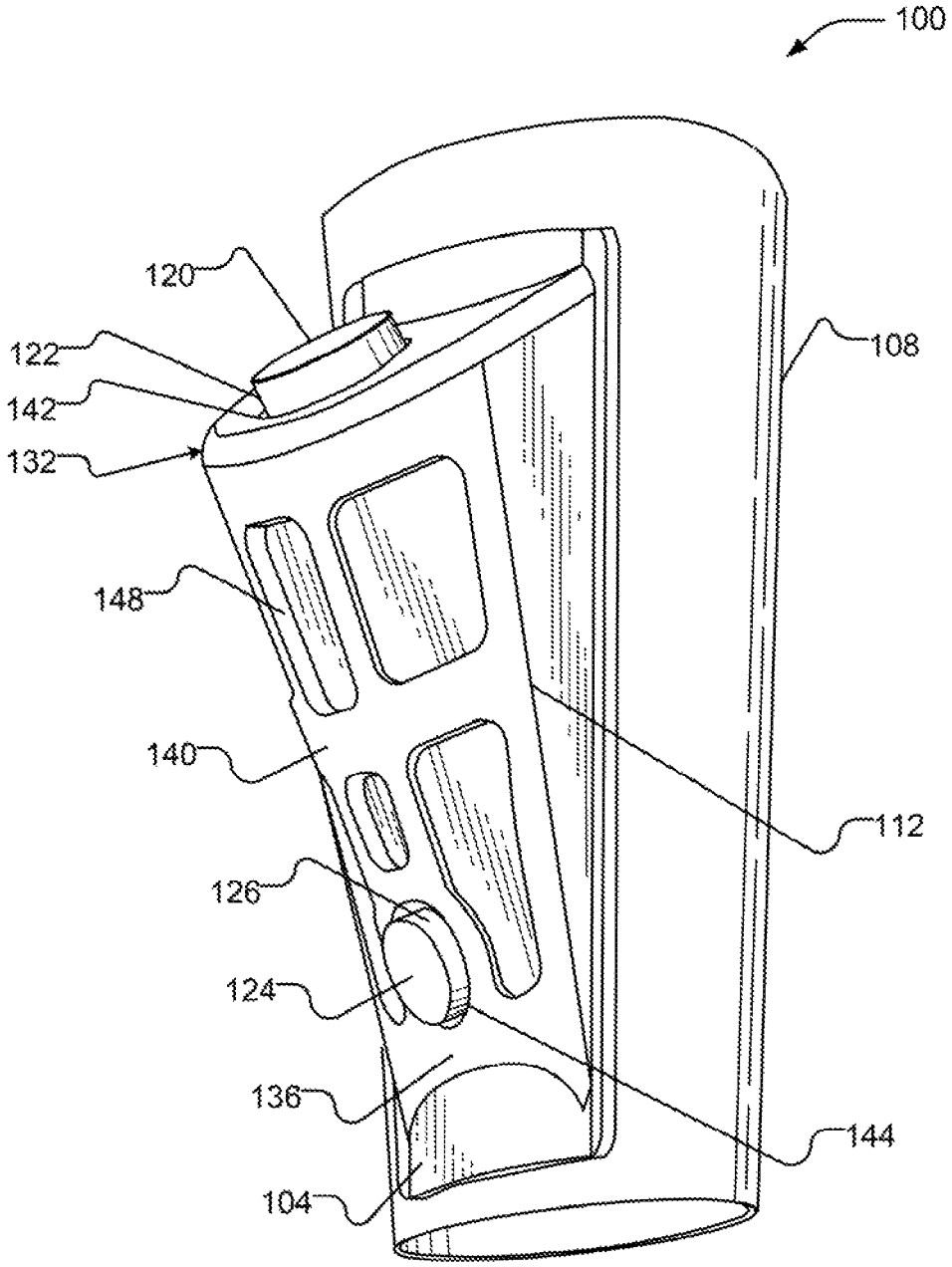
FIG. 1 is a perspective view of a hydration device according to an embodiment of the present invention.

With reference now to the drawings, and in particular to FIG. 1, there is shown a hydration device 100 according to an embodiment of the present invention. At a high level, device 100 includes a sleeve 108, an impact cage 112, and a bladder 104 having a refill port 120 and a valve port 124.

Sleeve 108 generally maintains the position of the impact cage 112 and bladder 104 on the user's limb throughout the course of the activity. In an exemplary embodiment, sleeve 108 is designed and configured to encircle a user's lower (forearm) and upper (bicep) arm, although sleeve 108 can be longer or shorter depending on the activity it is to be used for and the desires of the user. For example, a soccer player may only desire sleeve 108 to cover the forearm, whereas someone engaged in obstacle course racing may prefer a longer sleeve for greater abrasion protection on the user's arm.

Sleeve 108 can be made from many different types of materials, but is preferably made from an elastic material that has moisture-wicking properties, such as, but not limited to, neoprene, or other compression materials (typically blends of cotton, foam, elastic, and the like) that are suitable for maintaining its shape and the position of the remainder of hydration device 100 on the user's desired body location. In an exemplary embodiment, sleeve 108 is made from compression material that, in addition to maintaining the position of device 100 on the arm of the user, also serves to improve blood flow through the compressed area. In another exemplary embodiment, sleeve 108 includes strips or ridges on the inside portion of the sleeve that assist in maintaining the position of hydration device 100 during the activity. In an exemplary embodiment, strips of silicone are placed on the interior surface of sleeve 108, which maintain the position of hydration device 100 during the activity. In another exemplary embodiment, strips of a rubber (e.g., polymers of isoprene) are placed on the interior surface of sleeve 108, which maintain the position of hydration device 100 during the activity.

Impact cage 112 is coupled to sleeve 108 and generally supports bladder 104 and provides protection to the athlete's limb. Impact cage 112 has an outer structure 140 with a number of apertures 148. In this embodiment, outer structure 140 is sized and configured to conform to the user's limb, e.g., arm, at an intersection of sleeve 108 and impact cage 112. A lower portion of outer structure 140 tapers from a proximal end 132 to a distal end 136, thereby accommodating the smaller diameter of the user's wrist as compared to the user's forearm closer to the user's elbow. In an exemplary embodiment, the lower portion of outer structure 140 is sized and configured such that it couples to sleeve 108 on its edges and the sleeve is in contact with bladder 104 on the interior of the lower portion. Apertures 148 are designed and configured to reduce the weight of device 100 and can provide structural integrity on impact. In an exemplary embodiment, impact cage 112 is composed of rigid plastic, such as HDPE, or impact resistant foam, rubber materials, etc., but is not limited to these materials. In an exemplary embodiment, impact cage 112 is formed from materials suitable for receiving print customizations that may indicate a specific event, a logo, etc.

In an exemplary embodiment, outer structure 140 or a portion thereof uncouples from impact cage 112 or sleeve 108 along one or more edges so as to allow the insertion and removal of bladder 104 from proximal end 132. Outer structure 140 also includes a first aperture 144 for valve port 124 and a second aperture 142 that facilitates the refilling or emptying of bladder 104 at refill port 120.

Bladder 104 also includes refill port 120 through which the drink fluid may be poured into or removed from the reservoir. Refill port 120 also provides a passage through which the interior of the compartment may be accessed, such as for cleaning. Refill port 120 may include a neck, or neck portion, 122 that extends from bladder 104 and includes an opening through which drink fluid may exit the refill port. Although the body portion of bladder 104 is preferably flexible, neck 122 can be designed to retain its configuration and thereby maintain a seal with a closure member (not shown). Typically, neck 122 will have a defined shape, such as a circular or cylindrical shape, although other shapes could be employed.

Valve port 124 extends from bladder 104 via a tube 126. The length of tube 126 may vary but is generally sized to expose valve port 124 to the user from the outer surface of outer structure 140 but not extend so far as to interfere with a user's activities, such as scaling an obstacle in an obstacle course or interacting with an opposing player in a game. Valve port 124 may have a variety of configurations, from an open-ended tube, to including a device, such as a valve mechanism, that is coupled to the end of tube 126. An example of a suitable valve mechanism is a bite-actuated mouthpiece, which is placed in a user's mouth and configured from a closed, or sealed, position, to an open, or dispensing, position when a user bites upon the mouthpiece or otherwise compresses the mouthpiece with the user's lips or teeth.

Valve mechanism can be designed and configured to be a manually actuated on/off valve that is used to selectively prevent drink fluid from being dispensed through the valve port, regardless of the configuration of the valve. By "manually actuated," it is meant that the on/off valve is adapted to be actuated by a user exerting force on the valve, such as with the user's hands. Typically, a bite-actuated mouthpiece, or valve, will be self-sealing, in that it is adapted to automatically return to its closed position, while manually actuated on/off valves will typically remain in a selected position until repositioned by a user. Valve mechanism may also be spring-based to return to its closed position. Hydration device 100 may exclude a manually actuated on/off valve mechanism, opting for a different type of on/off valve, and/or with a manually actuated on/off valve that is positioned in an in-line configuration. By "in-line," it is meant that valve mechanism is coupled between adjacent lengths of tube 126. Valve port may include a cap that assists in preventing liquids from leaving bladder 104 when not desired and also prevents contaminants from entering bladder 104 during use.

Figure 2:
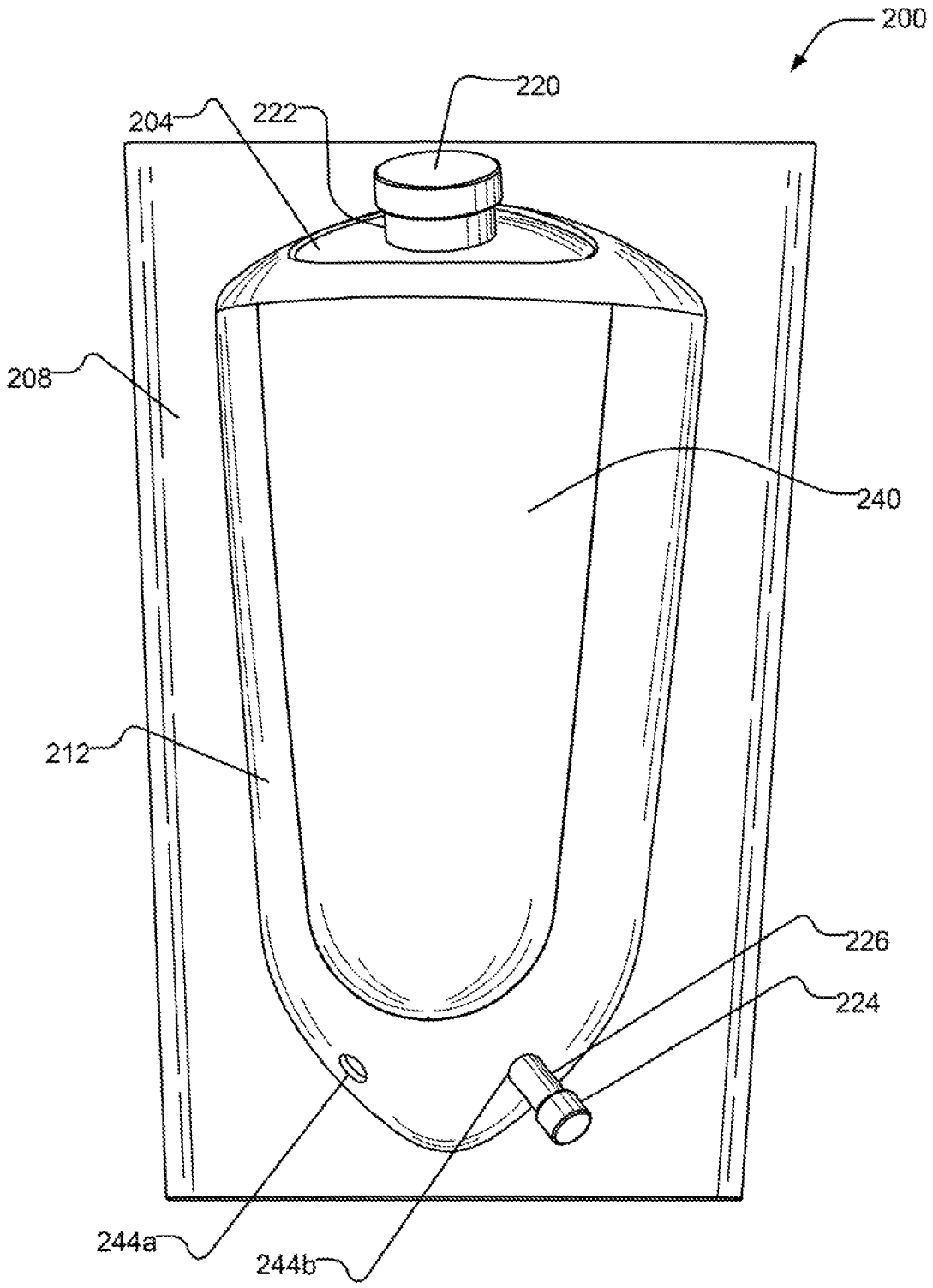
FIG. 2 is a perspective view of a hydration device according to another embodiment of the present invention.
Figure 3:
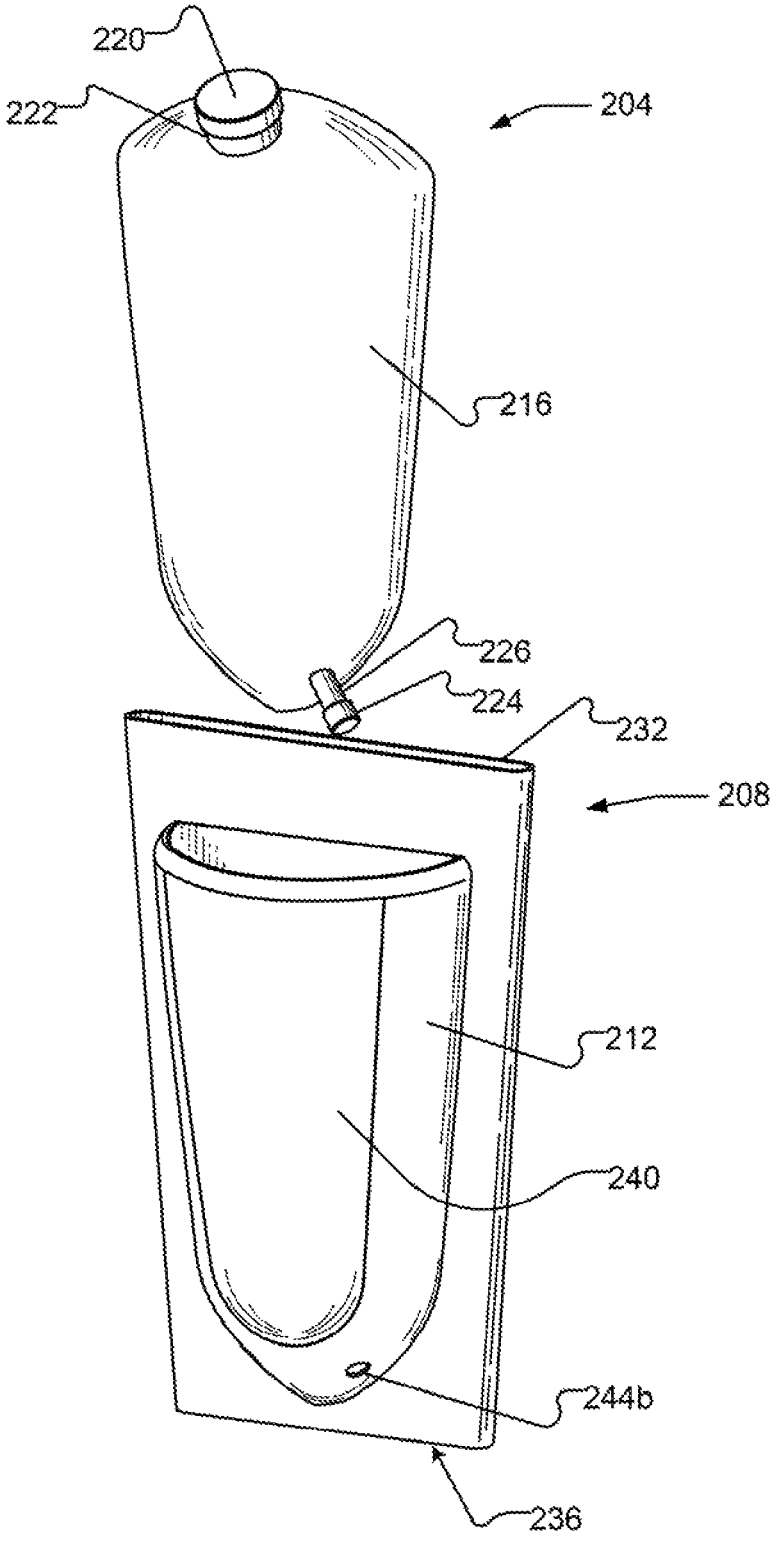
FIG. 3 is a perspective view of the hydration device of FIG. 2 with the bladder shown removed from the sleeve.
Figure 4:
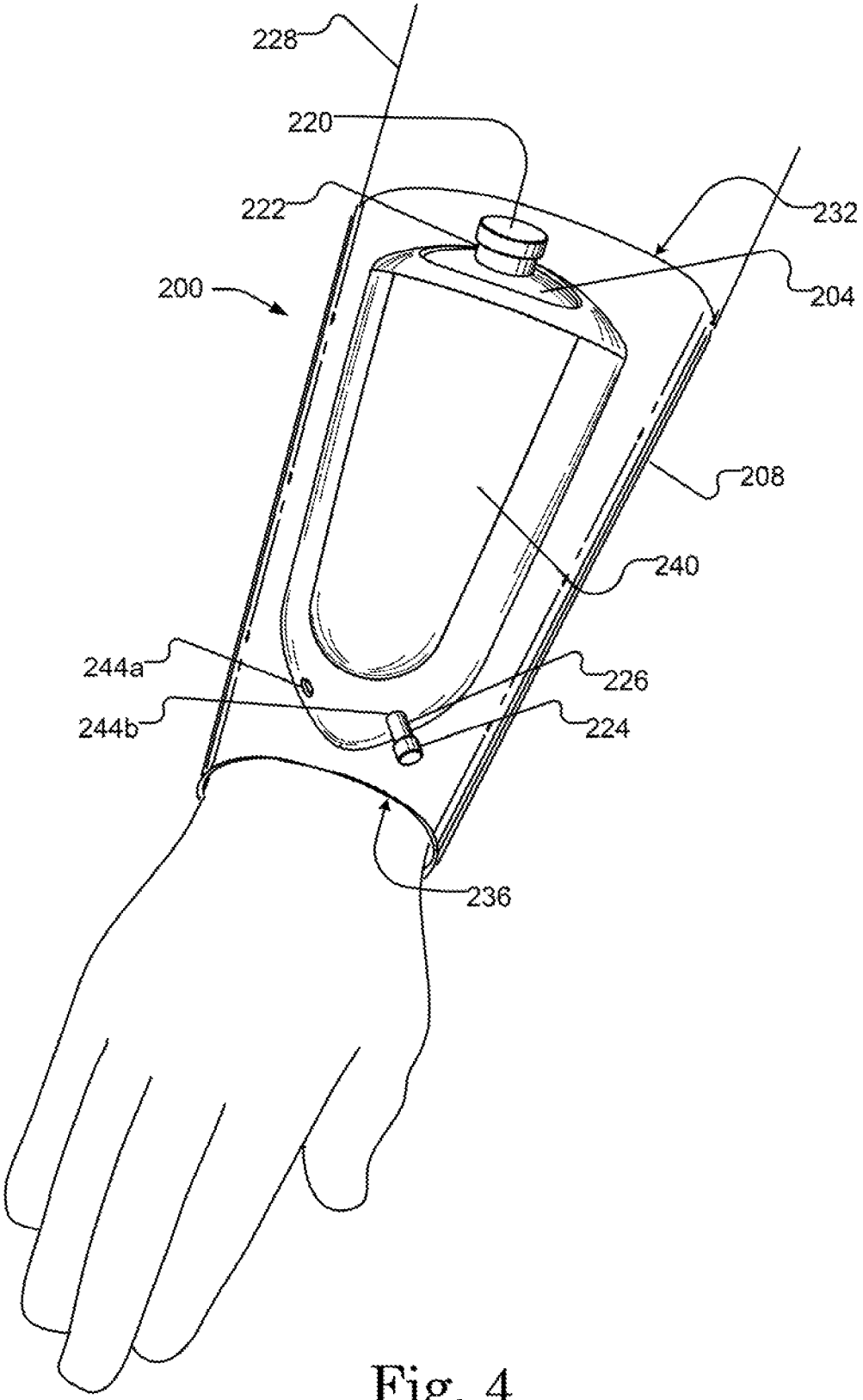
FIG. 4 is a perspective view of the hydration device of FIG. 2 depicted as worn by a user.

Another hydration device, device 200, is shown in FIGS. 2-4 and includes a bladder 204, a sleeve 208, and a cover 212. Bladder 204 (shown apart from sleeve 208 and cover 212 in FIG. 3) includes a body portion 216, a refill port 220 and a valve port 224. Body portion 216 defines an internal compartment, which is adapted to store a volume of a drink fluid, such as water, sports drinks, juice, etc. In an exemplary embodiment, at least body portion 216, if not the entirety of bladder 204, is formed from a flexible, waterproof material. An example of a suitable material is polyurethane, although others may be used. In a preferred embodiment, the compartment is sized and configured to be readily insertable and removable from device 200 as discussed further below. The size and shape of body portion 216 may vary depending upon the desired application with which the hydration device will be used. For example, the volume of drink fluid that the compartment is designed to hold may vary based on the size and needs of the user and the user's planned activities. Typically, the compartment will hold about 24 ounces, and may hold 12 ounces or less, or as much as 32 ounces, 50 ounces, 70 ounces, 100 ounces, or 200 ounces or more of a drink fluid, as may be appropriate for some situations and users.

Refill port 220 allows the drink fluid to be poured into or removed from the internal compartment of bladder 204. Refill port 220 also provides a passage through which the interior of the compartment may be accessed, such as for cleaning. Refill port 220 may include a neck, or neck portion, 222 that extends from bladder 204 and includes an opening through which drink fluid may exit refill port 220. Although the internal compartment of bladder 204 is preferably flexible, neck 222 can be designed to retain its configuration and thereby maintain a seal with a closure member (not shoat). Typically, neck 222 will have a defined shape, such as a circular or cylindrical shape, although other shapes could be employed.

Valve port 224 extends from bladder 204 via a tube 226. The length of tube 226 may vary, but is generally sized to expose the valve port to the user through cover 212 when bladder 204 is inserted in sleeve 208 but not extend so far as to interfere with a user's activities, such as scaling an obstacle in an obstacle course or interacting with an opposing player in a game. Valve port 224 may have a variety of configurations, from an open-ended tube, to including a device, such as a valve mechanism, that is coupled to the end of tube 226. An example of a suitable valve mechanism is a bite-actuated mouthpiece, which is placed in a user's mouth and configured from a closed or sealed, position, to an open, or dispensing, position when a user bites upon the mouthpiece or otherwise compresses the mouthpiece with the user's lips or teeth.

The valve mechanism of valve port 224 can be designed and configured to be a manually actuated on/off valve that is used to selectively prevent drink fluid from being dispensed through the valve port, regardless of the configuration of the valve. By "manually actuated," it is meant that the on/off valve is adapted to be actuated by a user exerting force on the valve, such as with the user's hands. Typically, a bite-actuated mouthpiece, or valve, will be self-sealing, in that it is adapted to automatically return to its closed position, while manually actuated on/off valves will typically remain in a selected position until repositioned by a user. The valve mechanism may also be spring based to return to its closed position. Hydration device 200 may exclude a manually actuated on/off valve mechanism, opting for a different type of on/off valve, and/or with a manually actuated on/off valve that is positioned in an in-line configuration. By "in-line," it is meant that valve mechanism is coupled between adjacent lengths of tube 226. Valve port 224 may include a cap that assists in preventing liquids from leaving bladder 204 when not desired and also prevents contaminants from entering bladder 204 during use.

Sleeve 208 (shown without a bladder inserted in FIG. 3) is sized and configured to fit securely over an arm 228 of a wearer (as shown in FIG. 4). In particular, sleeve 208 may have a generally tubular shape that tapers from a proximal end 232 to a distal end 236, where proximal end 232 is sized to fit securely over an upper forearm, elbow, or upper arm of a wearer and distal end 236 is sized to fit securely over a wearer's lower forearm or wrist. Sleeve 208 may be made of any suitable material, including, for example, neoprene.

In an exemplary embodiment, cover 212 includes a first surface 240. Cover 212 is sized and configured to hold bladder 204 on sleeve 208 and may attached along the edges of first surface 240 to a periphery of a sleeve 208 while remaining open at one end, such as near the proximal end 232 of sleeve 208, thus forming a pocket into which bladder 204 may be securely held during activities. The pocket holds bladder 204 securely whether bladder 204 is empty or full of liquid due to the resiliency/elasticity of cover 212. Cover 212 can be made of similar material to sleeve 208 or other materials known in the art, and preferably of a material with sufficient resiliency such that cover 212 will expand and contract as bladder 204 is filled and emptied, respectively.

Cover 212 also includes apertures 244 (e.g., 244*a*, 244*b*), preferably located near a distal (wrist) end of device 200 to accommodate valve port 224 of bladder 204. Including two apertures 244, one on either side of cover 212 on the distal portion of device 200, allows device 200 to be worn on a wearer's left or right arm and still have convenient access to vale port 224. Alternatively, a single aperture in cover 212 that is more centrally located with respect to the center of the user's arm may be included.

In another exemplary embodiment, cover 212 includes a second surface, and the second surface couples to sleeve 208 such that the second surface rests on top of sleeve 208 (essentially making two layers), while first surface 240 serves to form the pocket for holding bladder 204.

Figure 5:
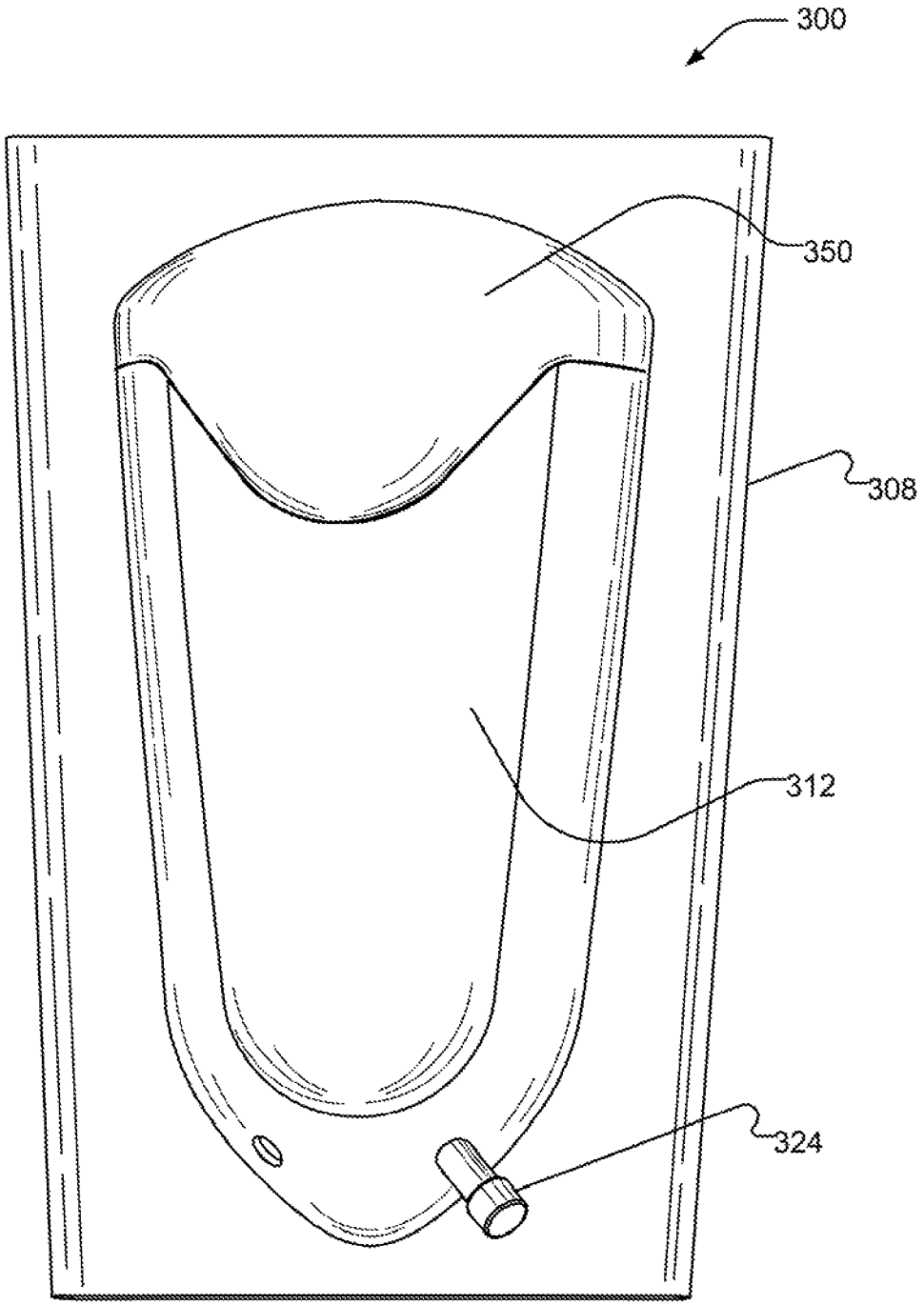
FIG. 5 is a perspective view of a hydration device according to another embodiment of the present invention.

In another embodiment, shown in FIG. 5, a hydration device, device 300, is similar to the above described hydration devices in that device 300 includes a bladder with a refill port (not shown) and a valve port 324, a sleeve 308 with an attached cover 312 forming a pocket for the bladder. In this embodiment, the pocket may be sealed with a resealable opening or flap 350 that is sized and configured to cover the opening through which the bladder may be inserted into and removed from the pocket. Flap 350 may be secured in a closed position using any suitable mechanism including for example a zipper, hook-and-loop, fasteners, a drawstring, or the like, and may optionally include an aperture for allowing the refill port to be accessible when flap 350 is closed.

Figure 6A:
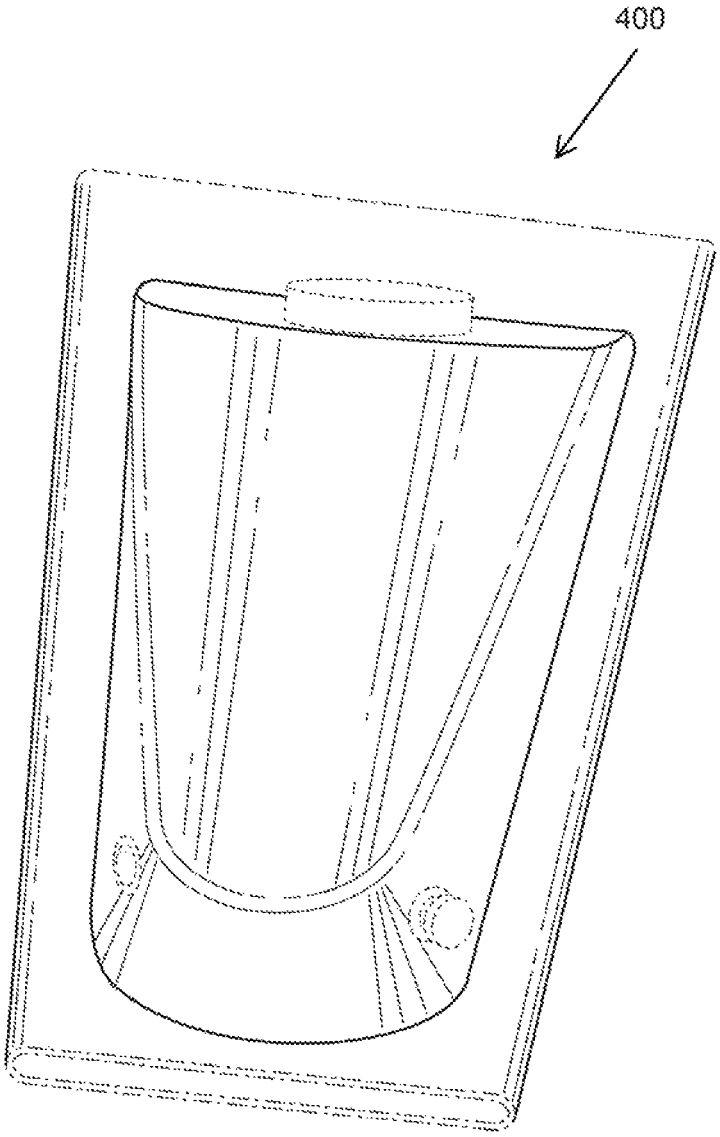
FIGS. 6*a*-6*j* depict perspective views of another hydration device according to an embodiment of the present invention.
Figure 6B:
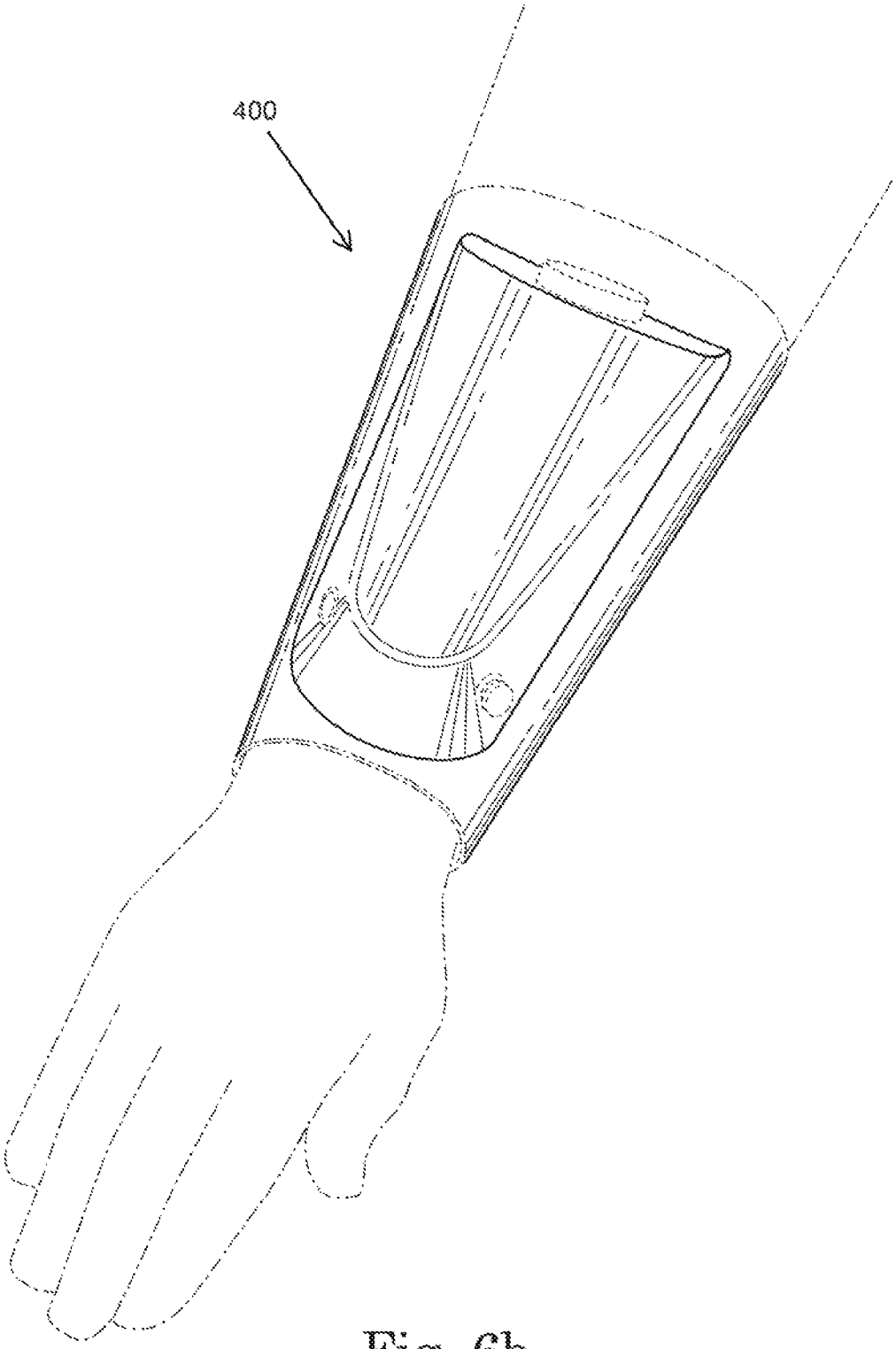
Figure 6C:
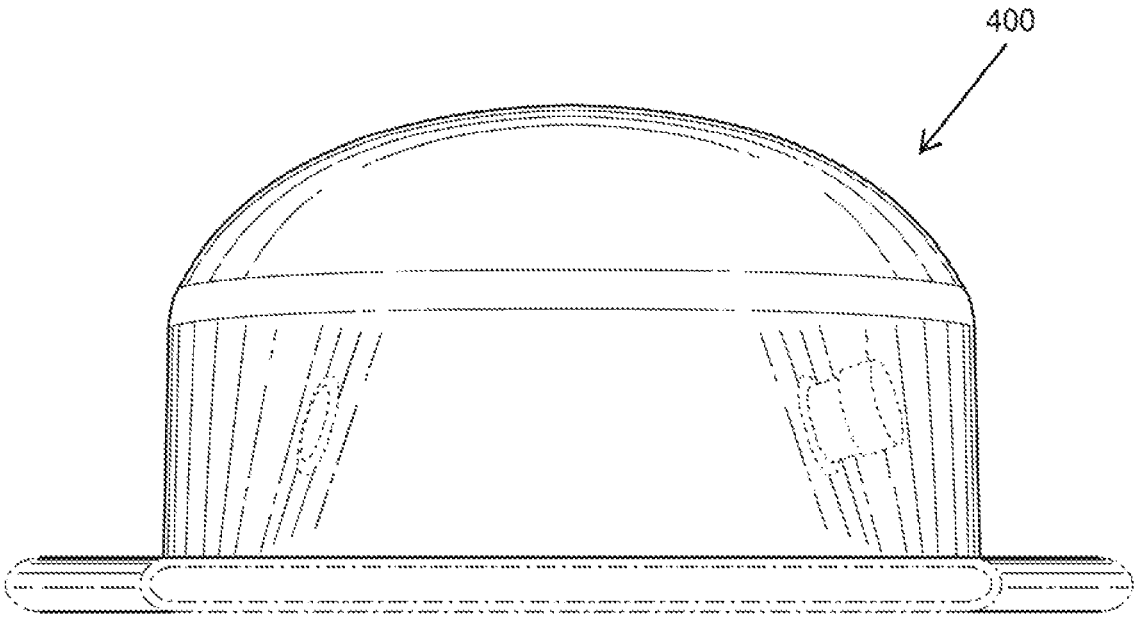
Figure 6D:
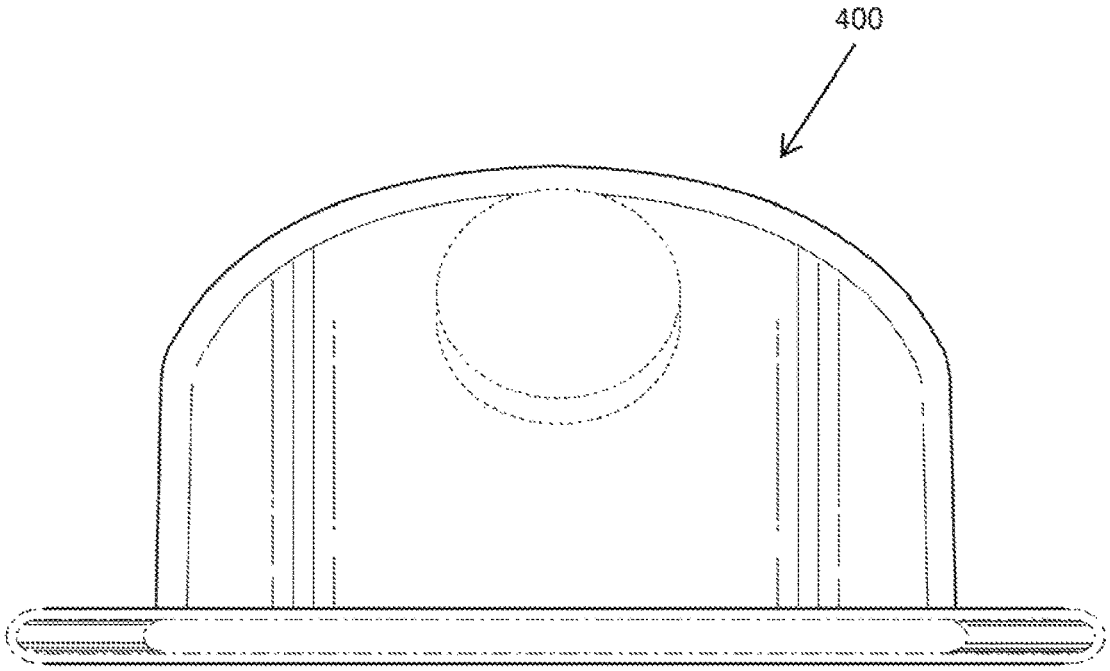
Figure 6E:
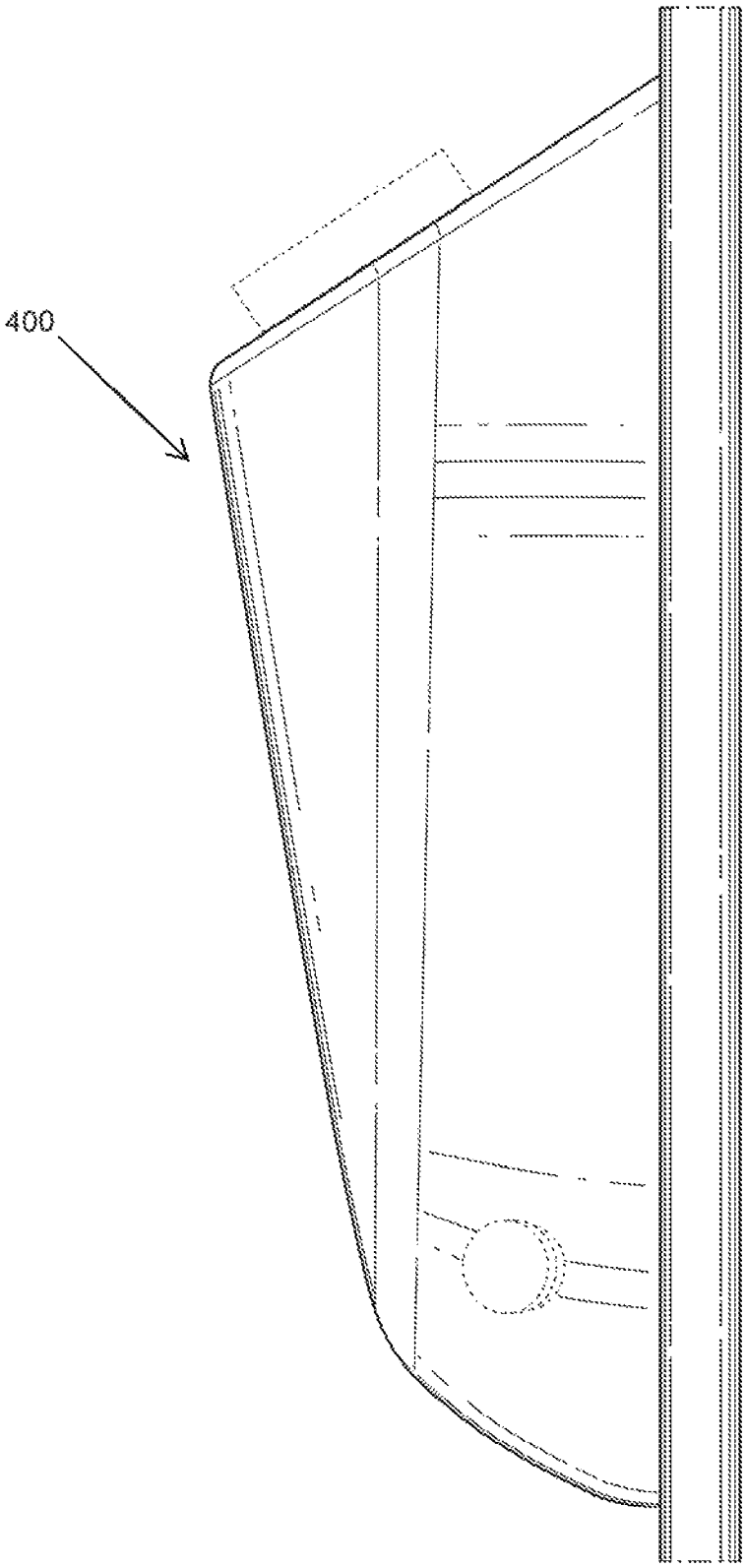
Figure 6F:
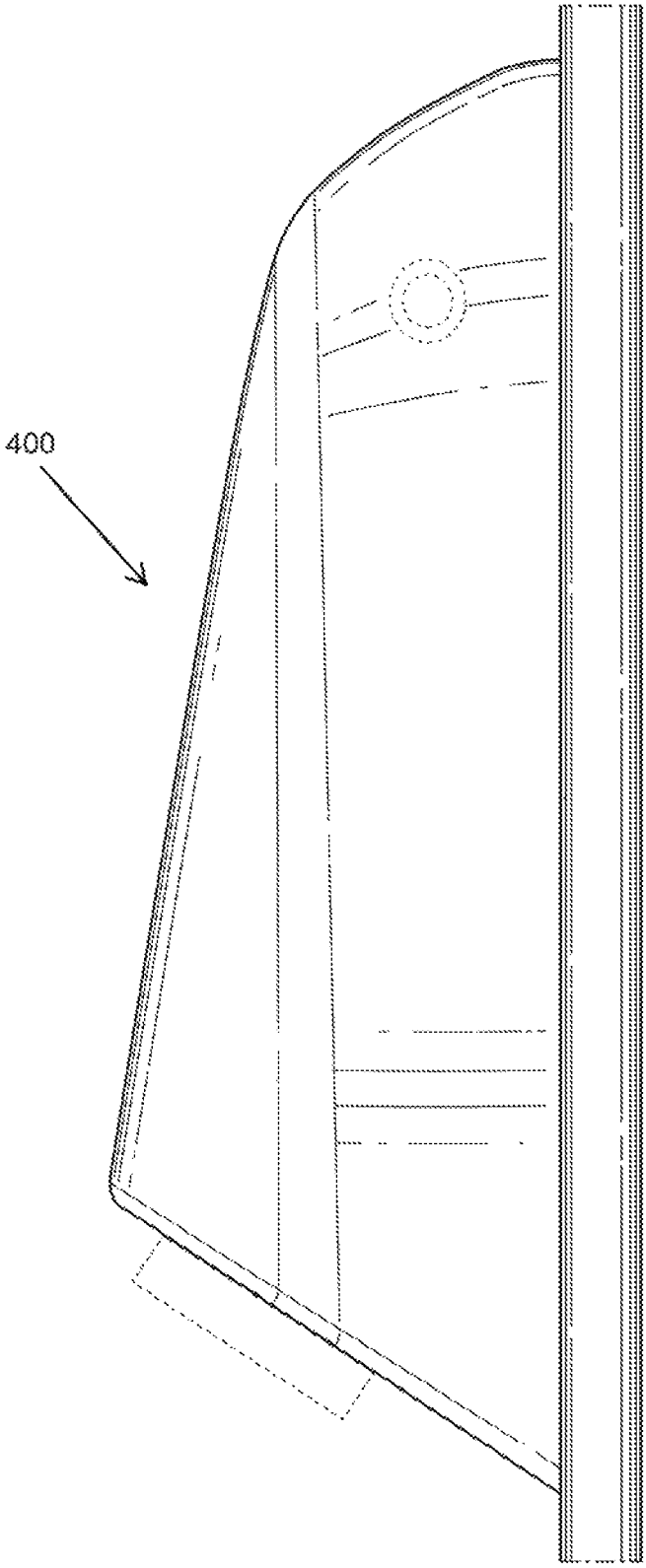
Figure 6G:
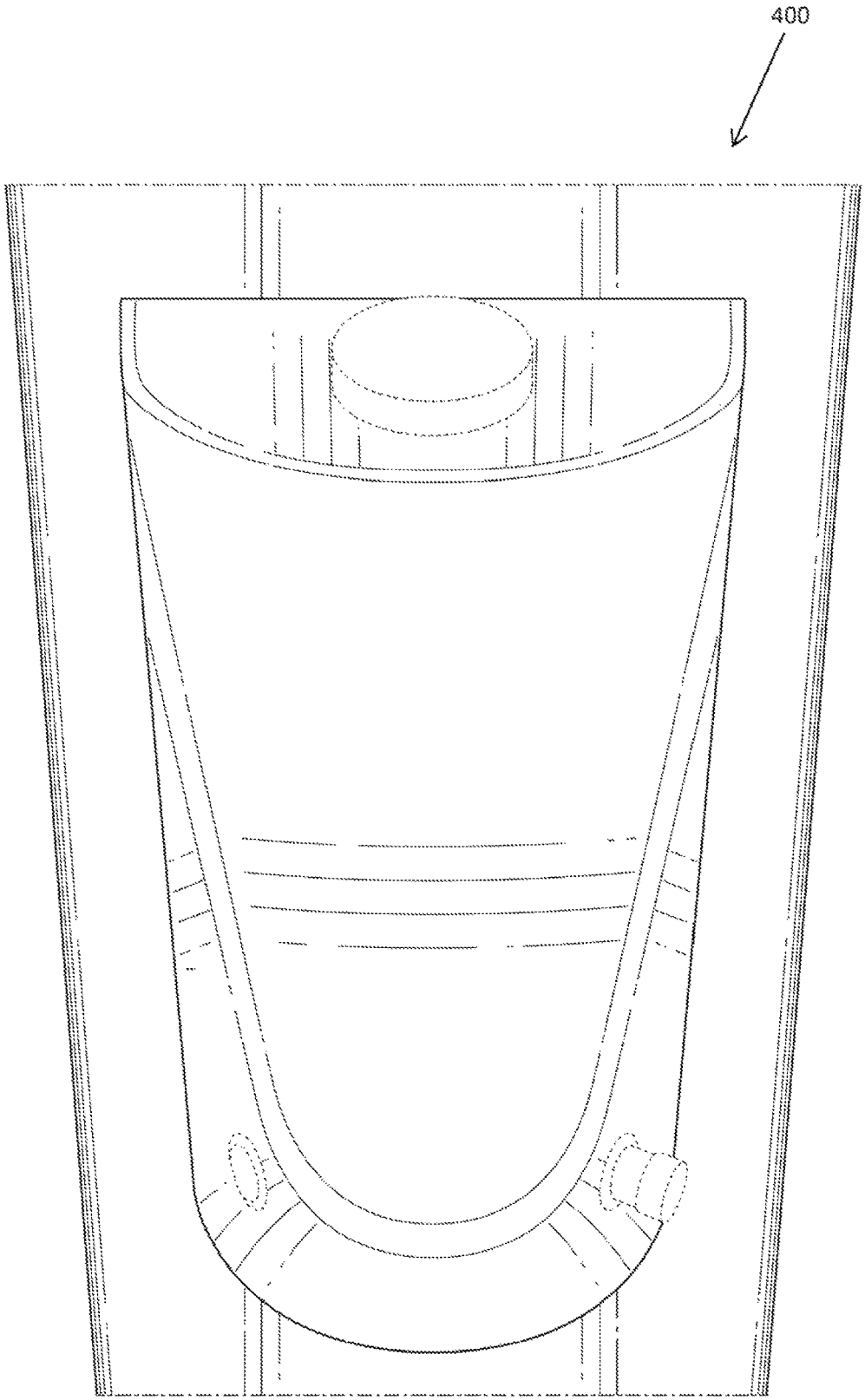
Figure 6H:
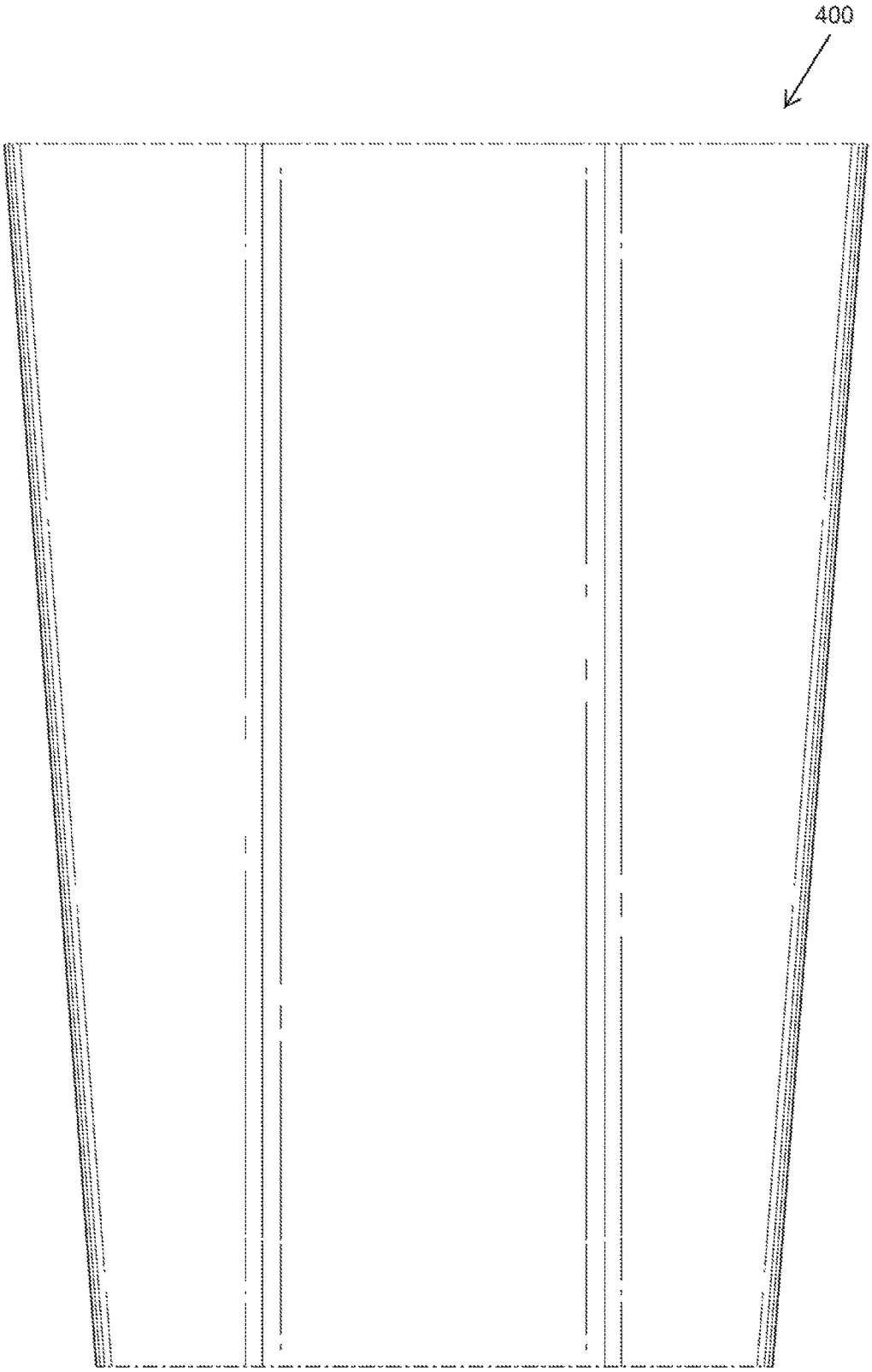
Figure 6I:
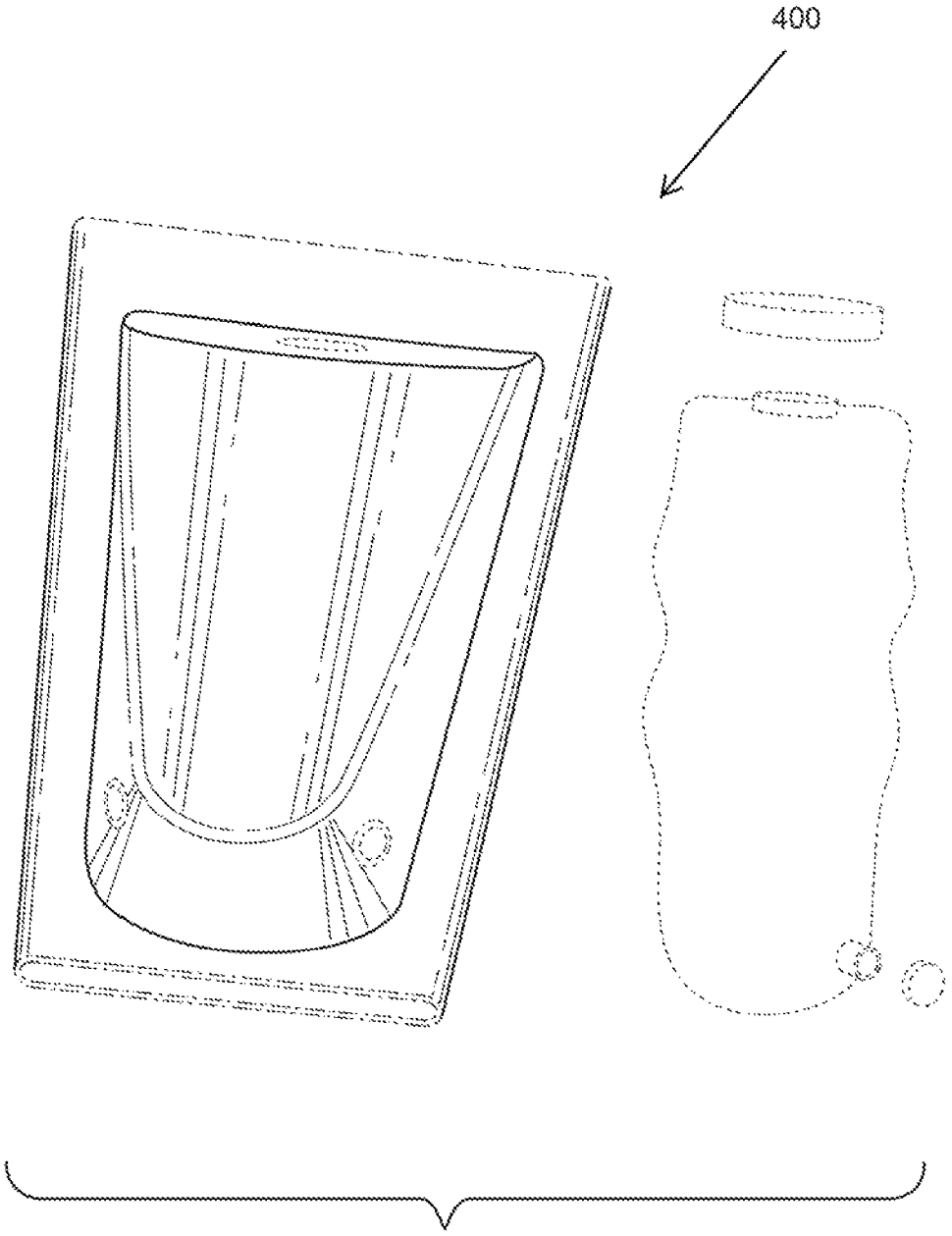
Figure 6J:
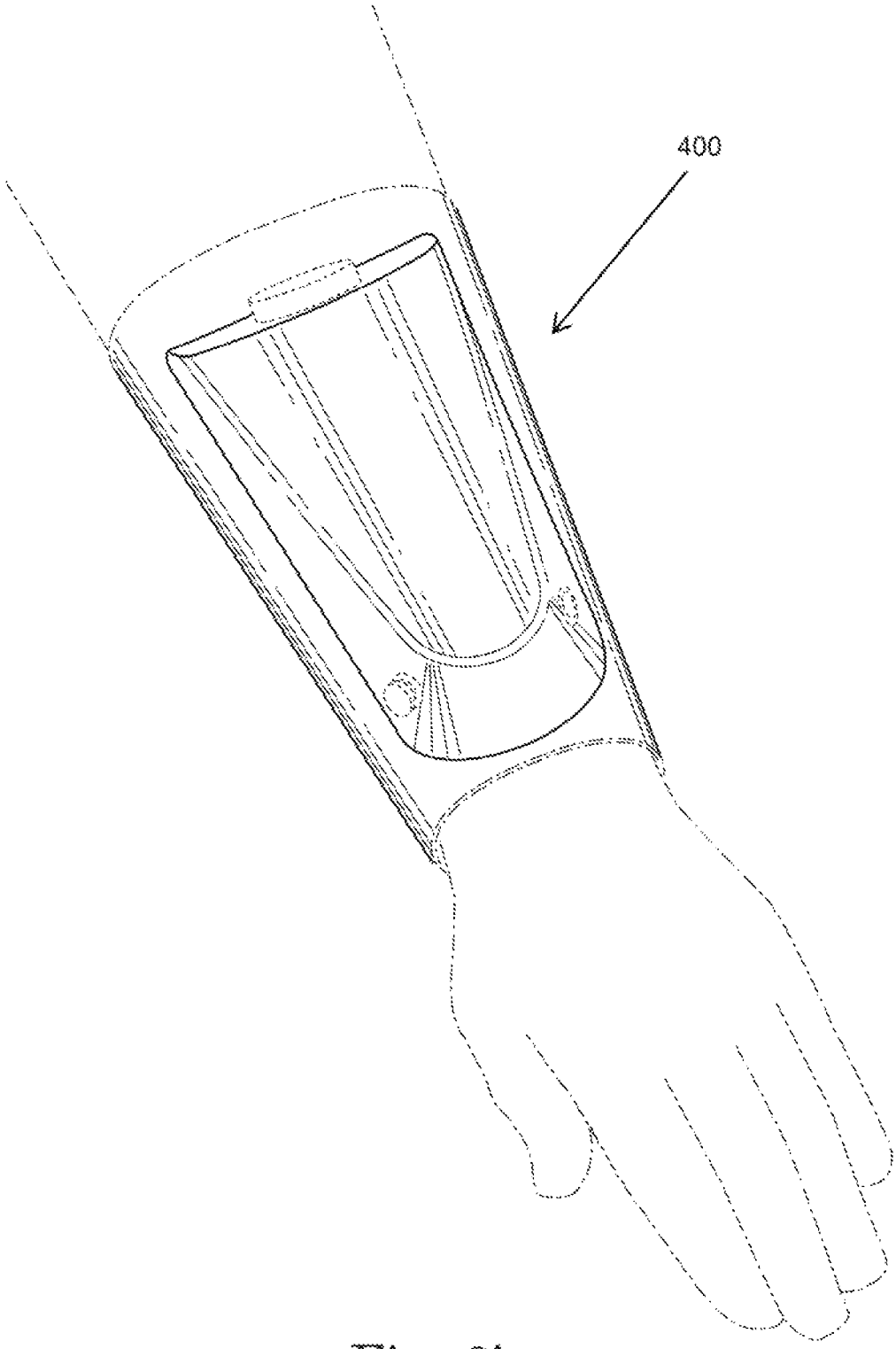

In another embodiment, shown in FIGS. 6*a*-6*j*, a hydration device, device 400, is similar to the above described hydration devices in that device 400 includes a bladder with a refill port and a valve port, and a sleeve that forms a pocket for removably securing the bladder. The sleeve is sized and configured to be securely worn on a user's arm (as shown in FIG. 6*b*, for example) and the pocket may include apertures sized and located to accommodate the refill port and the valve port, respectively, (as can be seen in FIG. 6*i*, for example). The bladder can be removed from the pocket (as shown in FIG. 6*i*) for easier filling and for cleaning. The pocket and bladder are preferably located on a dorsal side of a user's forearm when device 400 is worn by a user (FIGS. 6*b*,6*j*). In a preferred embodiment, two apertures for accommodating the valve port are included; one for when device 400 is worn on a left arm of a user (FIG. 6*j*) and one for when device 400 is worn on a right arm of a user (FIG. 6*b*). In this embodiment, the apertures for the valve port may be positioned toward a distal end (closer to the wrist of a wearer) and positioned about an equal distance from a center of the dorsal side of device 400 toward a first side and a second side, respectively (as can be seen in FIG. 6*g*, for example). For this embodiment, the bladder will be generally radially symmetric around a central axis, except for the valve port.

Embodiments of the hydration devices disclosed herein can also include storage areas that lack a manual closure, but substantially eliminate the ability of the contents of the storage area from falling out accidentally. The storage areas are typically integrated with or integral with the sleeve.

Exemplary embodiments have been disclosed above and illustrated in the accompanying drawings. It will be understood by those skilled in the art that various changes, omissions, and additions may be made to that which is specifically disclosed herein without departing from the spirit and scope of the present invention.

What is claimed is:

1. A body worn hydration device comprising:

a sleeve with a dorsal side and a sealable opening, the sleeve sized and configured to fit over a user's arm such that the sleeve has a generally tubular shape that tapers from a proximal end to a distal end, wherein the sleeve has a pair of apertures, a first aperture disposed in a first portion of the dorsal side and a second aperture disposed in a second portion of the dorsal side; and a bladder sized and configured to hold a liquid, to be removably contained within the sleeve on the dorsal side of the sleeve, and to be inserted and removed into the sleeve through the sealable opening, the bladder including a valve port and a refill port, wherein the valve port is positioned on the bladder such that when the bladder is contained in a first orientation within the sleeve the valve port protrudes through the first aperture and when the bladder is contained in a second orientation within the sleeve the valve port protrudes through the second aperture.

2. The body worn hydration device of claim 1 wherein the valve port is manually actuated.

3. The body worn hydration device of claim 1 wherein the valve port includes a bite-actuated mouthpiece.

4. The body worn hydration device of claim 1 wherein the bladder holds about 12 ounces of liquid.

5. The body worn hydration device of claim 1 wherein the bladder holds at least 24 ounces of liquid.

6. The body worn hydration device of claim 1 wherein the sleeve includes a compression material that serves to improve blood flow through the user's forearm when worn.

7. The body worn hydration device of claim 1 further including receptacles for containing personal items.

8. The body worn hydration device of claim 1 wherein the opening is sealable with a hook-and-loop fastener.

9. The body worn hydration device of claim 1 wherein the opening is sealable with a zipper.

10. The body worn hydration device of claim 1 wherein the device does not extend past a wrist toward a hand of a user when worn.

11. A wearable device for containing liquid consisting essentially of:

a sleeve with a first side, a second side, an inside portion, and an outside portion, the sleeve sized and configured such that the inside portion fits on a user's forearm and the sleeve has a generally tubular shape that tapers from a proximal end to a distal end, wherein the sleeve includes a first aperture, a second aperture, and a sealable opening; and a bladder sized and configured to be removably contained within the sleeve between the inside portion and the outside portion and to be inserted and removed through the sealable opening, the bladder including a valve port and a refill port, wherein the valve port is positioned on the bladder such that when the bladder is contained in a first position within the sleeve the valve port protrudes through the first aperture and when the bladder is contained in a second position within the sleeve the valve port protrudes through the second aperture, wherein the device is sized and configured to not extend past a wrist toward a hand of a user when fitting on the user's forearm.

12. The wearable device of claim 11 further including receptacles for containing personal items.

13. The wearable device of claim 11 wherein the opening is sealable with a hook-and-loop fastener.

14. The wearable device of claim 11 wherein the opening is sealable with a zipper.

15. The wearable device of claim 11 wherein the valve port includes a bite-actuated mouthpiece.

16. A body worn hydration device comprising:

a sleeve with a dorsal face, the sleeve sized and configured to fit over a user's arm such that the sleeve has a generally tubular shape that tapers from a proximal end to a distal end, wherein the sleeve has a first side running along a length of the sleeve and a second side running along the length of the sleeve opposite the first side;

a cover coupled to said sleeve and including a sealable opening, wherein the cover has a first edge that is attached to the sleeve on the first side substantially along the length of the sleeve, wherein the cover has a second edge that is attached to the sleeve near the second side substantially along the length of the sleeve, wherein the cover is positioned substantially on the dorsal face of the sleeve and forms a pocket on the dorsal face of the sleeve, and wherein the cover includes a first aperture positioned toward the first side of the sleeve and a second aperture positioned toward the second side of the sleeve; and a bladder sized and configured to hold liquid and to be inserted through the sealable opening and removably contained within the pocket, wherein the bladder includes a refill port and a valve port, and wherein the valve port is positioned on the bladder such that when the bladder is in a first position in the pocket the valve port can protrude from the first aperture and when the bladder is in a second position in the pocket the valve port can protrude from the second aperture.

17. The body worn hydration device of claim 16 wherein the refill port is positioned near the proximal end of the sleeve.

18. The body worn hydration device of claim 16 wherein the valve port includes a neck that protrudes through the cover sufficiently such that a user can drink from the valve port.

* * * * *